US008303288B2

(12) United States Patent
Huang et al.

(10) Patent No.: US 8,303,288 B2
(45) Date of Patent: Nov. 6, 2012

(54) MACHINE FOR MANUFACTURING NONWOVEN FABRIC

(75) Inventors: Tzu-Hsiang Huang, Taipei (TW); Ming-Chih Kuo, Tu-Chen (TW); Chao-Chun Peng, Hsinchu (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 116 days.

(21) Appl. No.: 12/641,527

(22) Filed: Dec. 18, 2009

(65) Prior Publication Data

US 2010/0159050 A1 Jun. 24, 2010

Related U.S. Application Data

(63) Continuation-in-part of application No. 12/346,003, filed on Dec. 30, 2008.

(30) Foreign Application Priority Data

Dec. 24, 2008 (TW) ..... 97150502 A

(51) Int. Cl.
*B28B 21/52* (2006.01)
*B29C 47/26* (2006.01)

(52) U.S. Cl. ..... 425/66; 425/71; 425/83.1; 425/282.2; 425/464

(58) Field of Classification Search ..... 264/172.11, 264/172.16, 211.14; 425/66, 71, 72.2, 378.2, 425/382.2, DIG. 217, 83.1, 464
See application file for complete search history.

(56) References Cited

U.S. PATENT DOCUMENTS

| | | | | |
|---|---|---|---|---|
| 2,939,177 | A * | 6/1960 | Guentert et al. | 264/143 |
| 3,436,792 | A * | 4/1969 | Hench | 425/72.2 |
| 4,204,828 | A * | 5/1980 | Peckinpaugh et al. | 425/72.2 |
| 4,340,559 | A * | 7/1982 | Yang | 264/181 |
| 5,538,682 | A * | 7/1996 | Bornmann et al. | 264/555 |
| 5,599,488 | A * | 2/1997 | Profe | 264/40.3 |
| 6,036,895 | A * | 3/2000 | Budenbender et al. | 264/28 |
| 6,132,661 | A * | 10/2000 | Kurihara et al. | 264/210.7 |
| 6,706,224 | B2 * | 3/2004 | Firgo et al. | 264/103 |
| 6,972,104 | B2 * | 12/2005 | Haynes et al. | 264/211.14 |
| 2005/0079348 | A1 * | 4/2005 | Lee et al. | 428/364 |

* cited by examiner

*Primary Examiner* — Joseph Del Sole
*Assistant Examiner* — Ryan Ochylski
(74) *Attorney, Agent, or Firm* — McClure, Qualey & Rodack, LLP

(57) ABSTRACT

A machine for manufacturing a nonwoven fabric includes a conveyer net, a spunbonding apparatus, and a container. In use, the spunbonding apparatus can project at least one fiber onto the conveyer net. The container can contain liquid, wherein the liquid level of the container is higher than at least a part of the conveyer net which the fiber is projected onto.

17 Claims, 5 Drawing Sheets

MACHINE FOR MANUFACTURING NONWOVEN FABRIC

CROSS-REFERENCE

The present application is a continuation-in-part application of U.S. application Ser. No. 12/346,003, filed Dec. 30, 2008, and claims priority to Taiwanese Application Serial Number 97150502, filed Dec. 24, 2008. The entire disclosures of all the above applications are hereby incorporated by reference herein.

BACKGROUND

1. Technical Field

The present disclosure relates to plastic and nonmetallic article shaping or treating processes. More particularly, the present disclosure relates to the plastic and nonmetallic article shaping or treating processes, wherein liquid of bath is in motion.

2. Description of Related Art

Nonwovens or non-woven materials are manufactured by binding fibers together in the form of a sheet or web.

One typical method to manufacture nonwovens is melt blowing. Melt blowing is a nonwoven forming process that extrudes a molten thermoplastic through a spin die with high velocity air to form fibers. The fibers are collected as a nonwoven onto a net. However, melt blown fibers are much shorter, and thus melt blown nonwovens typically have a problem of insufficient mechanical strength.

SUMMARY

According to one embodiment of the present invention, a machine for manufacturing a nonwoven fabric includes a conveyer net, a spunbonding apparatus, and a container. In use, the spunbonding apparatus can project at least one fiber onto the conveyer net. The container can contain liquid, wherein the liquid level of the container is higher than at least a part of the conveyer net which the fiber is projected onto.

DETAILED DESCRIPTION

Figure 1:
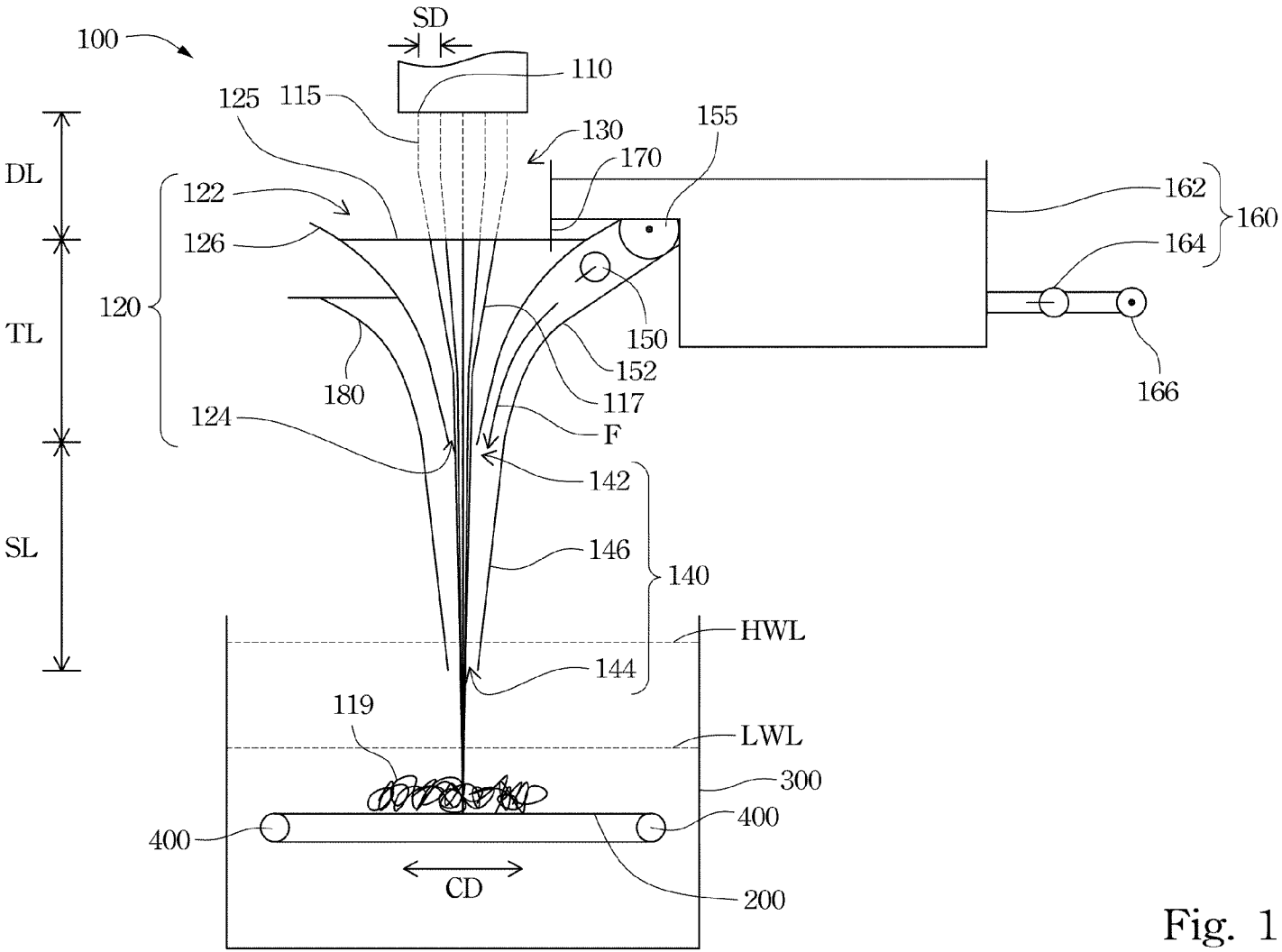
FIG. 1 is a schematic drawing of a machine for manufacturing a nonwoven fabric according to one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 is a schematic drawing of a machine for manufacturing a nonwoven fabric according to one embodiment of the present invention. As shown in FIG. 1, the machine for manufacturing the nonwoven fabric includes a conveyer net 200, a spunbonding apparatus 100, and a container 300. In use, the spunbonding apparatus 100 can project fibers 119 onto the conveyer net 200. The container 300 can contain liquid, wherein the liquid level of the container 300 is higher than at least a part of the conveyer net 200 which the fibers 119 are projected onto.

Specifically, the liquid contained by the container 300 submerges at least a part of the conveyer net 200 which the fibers 119 are projected onto. The liquid contained by the container 300 can slow the fibers 119 down and rearrange the fibers 119. As a result of the liquid, the orientations of the fibers 119 on the conveyer net 200 are uniformly and randomly distributed. This result can enhance the mechanical strength of the nonwoven fabric bonded together by the fibers 119, especially in the cross direction CD. That is, the nonwoven fabric bonded together by the fibers 119 will have substantially the same mechanical strength in every direction.

The liquid level of the container 300 may be slightly higher than the conveyer net 200 as indicated by LWL. Alternatively, the liquid level of the container 300 may be higher than the outlet 144 of the slit passage 140 of the spunbonding apparatus 100 as indicated by HWL. The person having ordinary skill in the art can determine the liquid level of the container 300 according to actual requirements.

Figure 2:
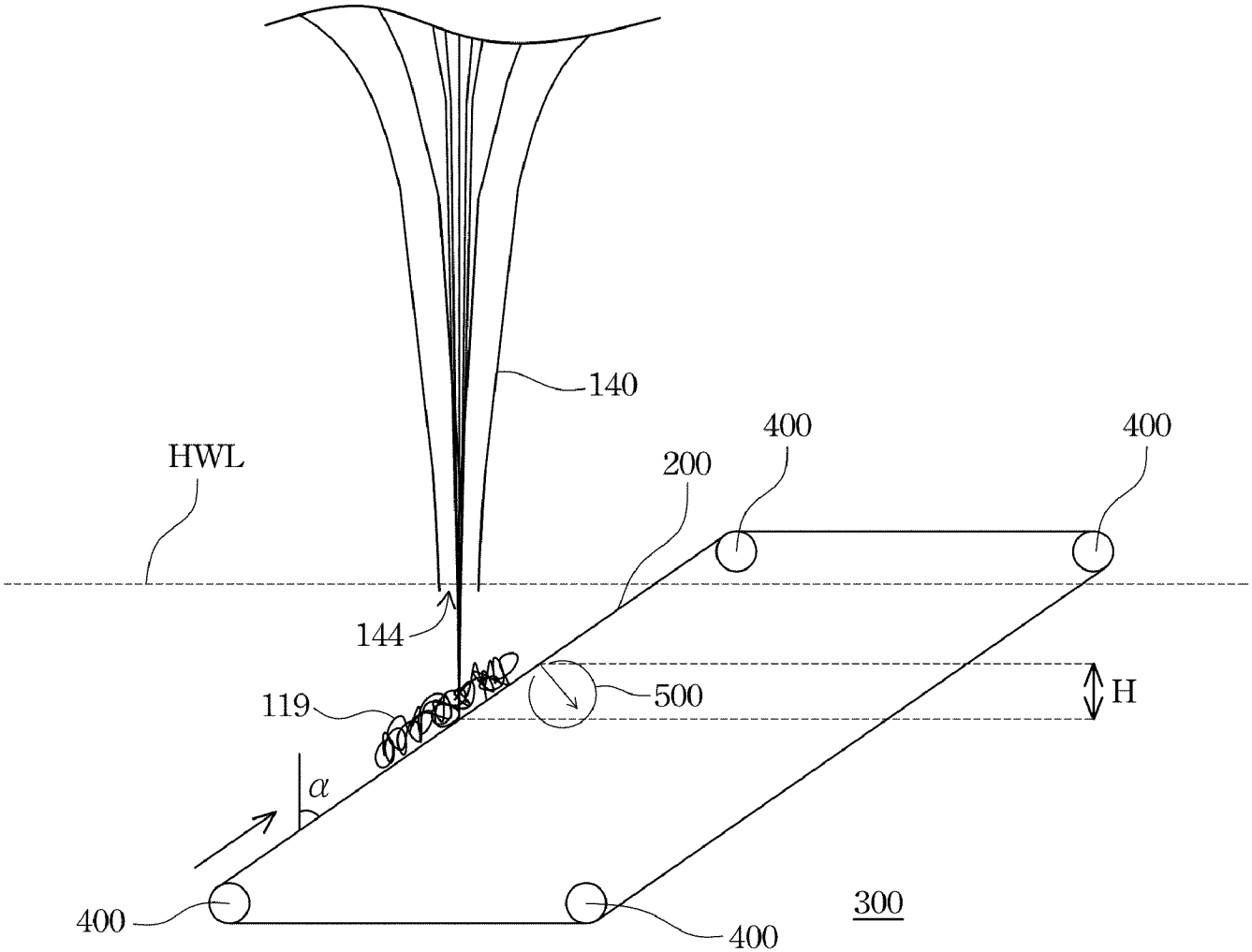
FIG. 2 is a schematic drawing of a machine for manufacturing a nonwoven fabric according to another embodiment of the present invention.

FIG. 2 is a schematic drawing of a machine for manufacturing a nonwoven fabric according to another embodiment of the present invention. As shown in FIG. 2, there may be a plurality of pulleys 400 for moving the conveyer net 200, wherein the pulleys 400 are positioned to maintain the conveyer net 200 at a substantial elevation above the horizontal to convey the fibers 119 out of the liquid, i.e. to maintain the conveyer net 200 at an angle between the horizontal and the vertical.

In one or more embodiments, the angle $\alpha$ between the slit passage 140 of the spunbonding apparatus 100 and the conveyer net 200 may be from about 0° to about 90° for conveying the fibers 119 out of the liquid. In one or more embodiments, the angle $\alpha$ between the slit passage 140 of the spunbonding apparatus 100 and the conveyer net 200 may be from about 0° to about 60° for controlling the time which the fibers 119 are immersed in the liquid.

The terms "about" as used herein may be applied to modify any quantitative representation which could permissibly vary without resulting in a change in the basic function to which it is related. For example, the angle $\alpha$ as disclosed herein may permissibly be greater than 60° within the scope of the invention if its conveying capability is not materially altered.

There may be a suction device 500 for sucking the fibers 119 onto the conveyer net 200. The suction device 500 may be located under the conveyer net 200, and a location on the conveyer net 200 which the suction device 500 sucks is higher than the projection of the slit passage 140 of the spunbonding apparatus 100 on the conveyer net 200.

In one or more embodiments, a height H between the location on the conveyer net 200 which the suction device 500 sucks and the projection of the slit passage 140 of the spunbonding apparatus 110 on the conveyer net 200 may be from about 0 cm to about 10 cm. In one or more embodiments, the height H is in the range from about 0 cm to about 10 cm for making sure that the fibers 119 will be uniformly distributed on the conveyer net 200.

Although the sucking direction of the suction device 500 is shown to be perpendicular to the conveyer net 200, the sucking direction of the suction device 500 may vary. That is, the person having ordinary skill in the art can select a proper sucking direction according to actual requirements.

The spunbonding apparatus 100 shown in FIGS. 1 and 2 may includes at least one nozzle 110, a coagulating tank 120, a slit passage 140, and a drawing flow pump 150. The coagulating tank 120 is located apart from the nozzle 110. That is, there is a deformation region 130, i.e. a gap, between the coagulating tank 120 and the nozzle 110. The coagulating tank 120 includes an inlet 122, an outlet 124, and a tank wall 126. The inlet 122 faces the nozzle 110. The tank wall 126 connects the inlet 122 to the outlet 124. The slit passage 140 is connected to the outlet 124 of the coagulating tank 120. The drawing flow pump 150 connects a drawing flow source 155 to the slit passage 140.

In use, the nozzle 110 may extrude at least one spinning solution 115 into the coagulating tank 120. The coagulating tank 120 may contain coagulating liquid 125 to coagulate the spinning solution 115 into at least one fiber 117. In the meantime, the drawing flow pump 150 may provide a drawing flow F to the slit passage 140 to pull the fiber 117 downwards through the slit passage 140. Since a portion of the fiber 117, the spinning solution 115 to be exact, which is located in the deformation region 130 has not coagulated yet, the fiber 117 can be lengthened by the pull of the drawing flow F.

In FIG. 1, dashed lines represent the spinning solution 115 which has not coagulated yet, and the coagulated fiber 117 is represented by continuous lines.

In the present embodiment, the spinning solution 115 may comprise a cellulose material, for example Peach™ pulp (Lyocell) available from Weyerhaeuser (Asia) Ltd. Table 1 lists the contents of Peach™ pulp.

TABLE 1

| Contents of Peach ™ pulp | | | |
|---|---|---|---|
| Cellulose Content | Degree of Polymerization | Solvent | Solvent Molecular Formula |
| 10 wt % | 400~700 | N-Methylmorpholine-N-oxide (NMMO) | $O(C_4H_8)NOCH_3$ |

Both the coagulating liquid 125 and the drawing flow F may be water when the spinning solution 115 is Peach™ pulp (Lyocell) available from Weyerhaeuser (Asia) Ltd. Furthermore, the liquid contained by the container 300 can be water as well. It is easily understood that although the coagulating liquid 125, the drawing flow F, the liquid contained by the container 300, and the spinning solution 115 are exemplified in the present embodiment, their spirit and scope of the appended claims should not be limited to the particular embodiment disclosed herein. The person having ordinary skill in the art should select proper coagulating liquid, drawing flow, liquid contained by the container and/or spinning solution according to actual requirements.

The nozzle 110 may be single or plural. For example, FIG. 1 shows that a plurality of the nozzles 110 are arranged in a plurality of rows to extrude the spinning solutions 115 simultaneously.

Furthermore, the area of the outlet 124 of the coagulating tank 120 may be less than the area of the inlet 122 of the coagulating tank 120 to bundle the fibers 117. It is easily understood that although the coagulating tank 120 is exemplified in the present embodiment, their spirit and scope of the appended claims should not be limited to the particular embodiment disclosed herein. The person having ordinary skill in the art should select a proper coagulating tank according to actual requirements.

As shown in FIG. 1, the spunbonding apparatus 100 may further include means 160 for supplying the coagulating liquid 125 to the coagulating tank 120. Specifically, the supplying means 160 may include a supplying tank 162 and a supplying pump 164. The supplying tank 162 is connected to the coagulating tank 120. The supplying pump 164 connects a coagulating liquid source 166 to the supplying tank 162. In use, the supplying pump 164 may pump the coagulating liquid 125 from the coagulating liquid source 166 into the supplying tank 162 until the fluid level of the supplying tank 162 has been higher than the fluid level of the coagulating tank 120. Then, the coagulating liquid 125 can flow from the supplying tank 162 into the coagulating tank 120 by the force of gravity.

In some case, the coagulating liquid 125 which flows from the supplying tank 162 into the coagulating tank 120 may induce a turbulent flow or even waves in the coagulating tank 120. The turbulent flow or the waves may entangle the fibers 117. In order to prevent the entanglement of the fibers 117, a baffle 170 may extend from the supplying tank 162 to or even under the fluid level of the coagulating tank 120 to restrain turbulence in the coagulating liquid 125.

The spunbonding apparatus 100 of the present embodiment may further include a drawing flow passage 152. The drawing flow passage 152 connects the drawing flow pump 150 to the slit passage 140 to direct the drawing flow F towards the slit passage 140. Moreover, in order to prevent the drawing flow F from flowing into the coagulating tank 120 to induce a turbulent flow, an overflow 180 may be located opposite the drawing flow passage 152. The coagulating liquid 125 and/or the drawing flow F may flow out of the slit passage 140 through the overflow 180 when it becomes too full. When the spinning solution 115 is Peach™ pulp (Lyocell) available from Weyerhaeuser (Asia) Ltd, the overflow 180 may be connected to a recycling device to recycle the solvent, i.e. N-Methylmorpholine-N-oxide (NMMO), from the coagulating liquid 125 and/or the drawing flow F.

In the present embodiment, the slit passage 140 may include an inlet 142, an outlet 144, and a wall 146. The inlet 142 of the slit passage 140 is connected to the outlet 124 of the coagulating tank 120, the overflow 180, and the drawing flow passage 152. The area of the outlet 144 of the slit passage 140 is equal to the area of the inlet 142 of the slit passage 140. The wall 146 connects the inlet 142 of the slit passage 140 to the outlet 144 of the slit passage 140. That is, the slit passage 140 may be a long pipe with a constant width. The width of the slit passage 140 may be 1-100 mm, and the length of the slit passage 140 may be 100-1000 mm, 200-500 mm, or 400-450 mm.

The spunbonding apparatus 100 described above may be also made and used in accordance with the spunbonding apparatus disclosed in copending application Ser. No. 12/346,003, filed on Dec. 30, 2008, which application is hereby incorporated herein by reference.

Working Example

A plurality of working examples are disclosed below. In those working examples, a series of tests were run to determine the orientations of the fibers manufactured by the nonwoven fabric manufacturing machine disclosed in the above-mentioned embodiment. The parameters described before are not repeated hereinafter, and only further information is supplied to actually perform the nonwoven fabric manufacturing machine.

In each working example, the fibers were manufactured by the nonwoven fabric manufacturing machine of FIG. 2, wherein the spinning solution was Peach™ pulp (Lyocell) available from Weyerhaeuser (Asia) Ltd, and the coagulating liquid, the liquid contained by the container, and the drawing flow were water. Tables 2-8 list the size of the nonwoven fabric manufacturing machine of each working example. Table 9 lists the manufacture parameters of each working example. Table 10 lists the result of each working example.

TABLE 2

| Size of Spunbonding Apparatus | | | |
|---|---|---|---|
| Working Example | Area of Nozzle Plate ($mm^2$) | Nozzle Space SD (mm)[1] | Inner Diameter of Nozzle (mm) |
| 1-2 | 135 mm × 12.2 mm | 4 | 0.25 |

Note

[1]Both the column spacing and the row spacing were 4 mm.

TABLE 3

| Size of Spunbonding Apparatus | | | |
|---|---|---|---|
| Working Example | Length of Deformation Region DL (mm) | Length of Coagulating Tank TL (mm) | Length of Slit Passage SL (mm) |
| 1-2 | 150 | 400 | 400 |

TABLE 4

| Size of Spunbonding Apparatus | | |
|---|---|---|
| Working Example | Inlet Area Of Coagulating Tank ($mm^2$) | Outlet Area Of Coagulating Tank ($mm^2$) |
| 1-2 | 216 mm × 62.5 mm | 216 mm × 1 mm |

TABLE 5

| Size of Spunbonding Apparatus | | | |
|---|---|---|---|
| Working Example | Inlet Area of Overflow ($mm^2$) | Outlet Area of Overflow ($mm^2$) | Length of Overflow (mm) |
| 1-2 | 216 mm × 1 mm | 216 mm × 10 mm | 250 mm |

TABLE 6

| Size of Spunbonding Apparatus | | | |
|---|---|---|---|
| Working Example | Inlet Area of Drawing Flow Passage ($mm^2$) | Outlet Area of Drawing Flow Passage ($mm^2$) | Length of Drawing Flow Passage (mm) |
| 1-2 | 216 mm × 15 mm | 216 mm × 2 mm | 450 mm |

TABLE 7

| Size of Spunbonding Apparatus | | |
|---|---|---|
| Working Example | Inlet Area of Slit Passage ($mm^2$) | Outlet Area of Slit Passage ($mm^2$) |
| 1-2 | 216 mm × 4 mm | 216 mm × 4 mm |

TABLE 8

| Size of Container, Conveyer Net, and Suction Device | | | |
|---|---|---|---|
| Working Example | Liquid Level[2] (cm) | Angle α (°) | Height H (cm) |
| 1 | 0 | 90 | 15 |
| 2 | 5 | 90 | 15 |

Note

[2]The liquid levels were measured from the conveyer net.

TABLE 9

| Manufacture Parameters of Each Working Example | | | | | | | | |
|---|---|---|---|---|---|---|---|---|
| | Supplying Pump | | Drawing Flow Pump | | Extrusion | Single Nozzle | Total | |
| Working Example | Horsepower (HP) | Frequency (Hz) | Horsepower (HP) | Frequency (Hz) | Temperature (° F.) | Extrudate (g/min/hole) | Flow ($m^3$/min) | Velocity (m/min)[3] |
| 1 | 1.5 | 30 | 1.5 | 30 | 260 | 0.5 | 137 | 260 |
| 2 | 1.5 | 30 | 1.5 | 30 | 260 | 0.5 | 137 | 260 |

Note

[3]the velocity of the coagulating liquid was sensed at the outlet of the slit passage.

TABLE 10

Figure 3:
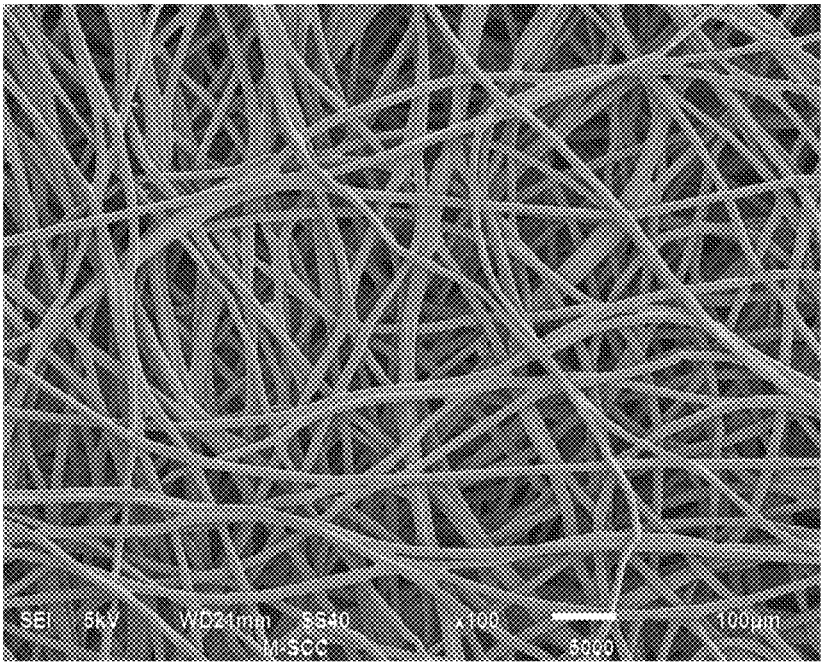
FIG. 3 is a scanning electron microscope (SEM) of fibers obtained by the working example 1.
Figure 4:
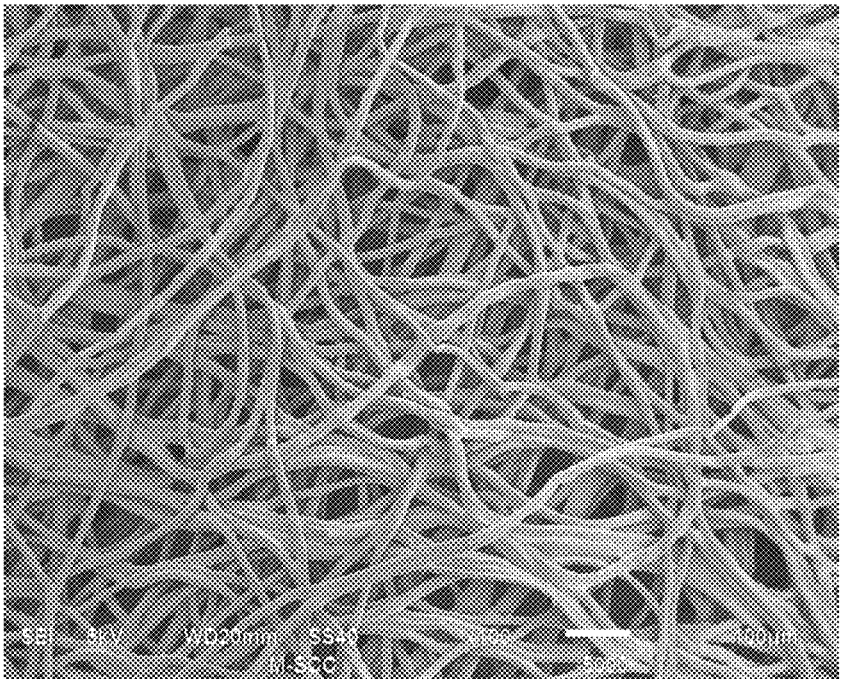
FIG. 4 is an SEM of fibers obtained by the working example 2.
Figure 6:
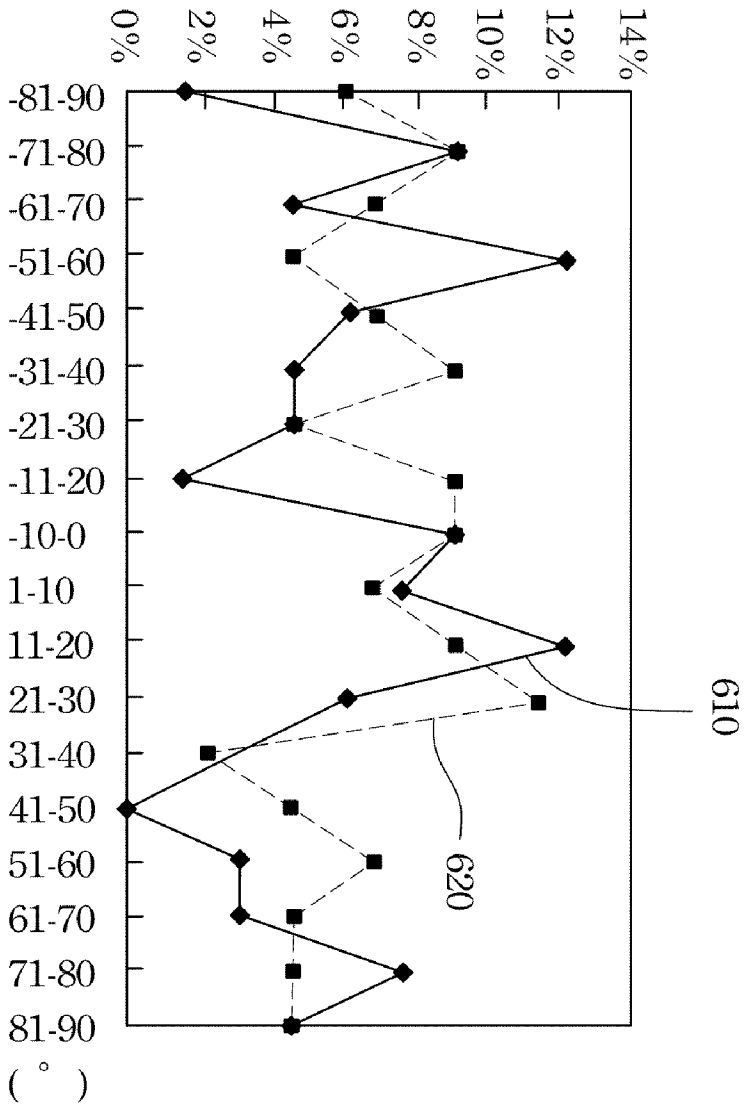
FIG. 6 is a graph of the fiber orientation distributions of the working examples 1-2.

| Orientations of Fibers | | |
|---|---|---|
| Working Example | Scanning Electron Microscope (Ratio: 100X) | Fiber Orientation Distribution[4] |
| 1 | FIG. 3 | Curve 610 of FIG. 6 |
| 2 | FIG. 4 | Curve 620 of FIG. 6 |

Note

Figure 5A:
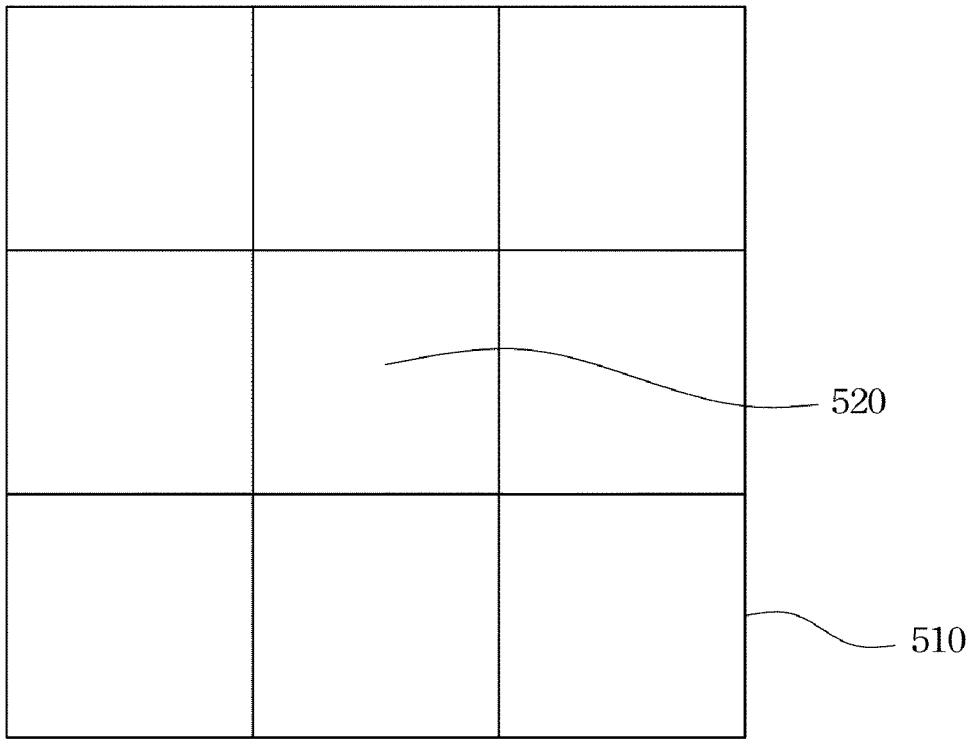
FIGS. 5A and 5B are diagrams of the fiber orientation.
Figure 5B:
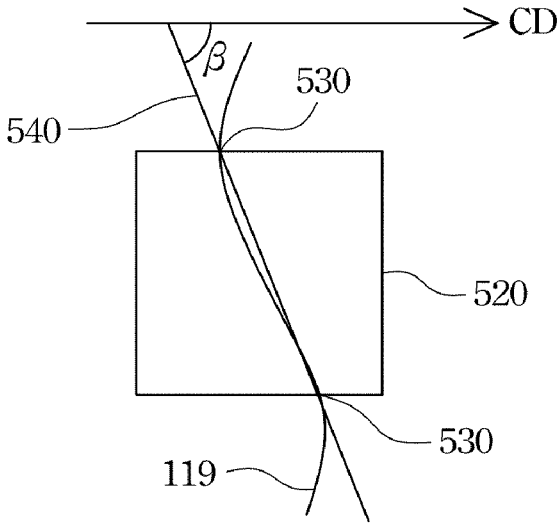

[4]The orientation of each fiber was determined by the following steps:

(1) dividing a scanning electron microscope 510 (SEM) into nine rectangular elements 520 (as shown in FIG. 5A);

(2) finding two points 530 at which each fiber 119 crosses the edge of each rectangular element 520 (as shown in FIG. 5B);

(3) creating a straight line 540 containing the points 530 (as shown in FIG. 5B); and (4) determining the angle β between the straight line 540 and the cross direction CD (as shown in FIG. 5B).

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims is not intended to invoke the provisions of 35 U.S.C. §112, 6th paragraph.

What is claimed is:

1. A machine for manufacturing a nonwoven fabric, the machine comprising:

a conveyer net;

a spunbonding apparatus for projecting at least one fiber onto the conveyer net, wherein the spunbonding apparatus comprises:

at least one nozzle for extruding at least one spinning solution;

a coagulating tank for containing a coagulating bath to coagulate the spinning solution into the fiber, the coagulating tank having a tank wall, the tank wall being liquid-holding such that the coagulating liquid is directly held by the tank wall;

a deformation region located between the coagulating tank and the nozzle;

an outer wall covering the tank wall of the coagulating tank, wherein the outer wall and the tank wall of the coagulating tank define a drawing flow passage therebetween;

a slit passage connected to the coagulating tank for allowing the fiber to pass therethrough; and a drawing flow pump for providing a drawing flow to the slit passage through the drawing flow passage to project the fiber onto the conveyer net; and means for containing liquid submerging at least a part of the conveyer net which the fiber is projected onto.

2. The machine of claim 1, further comprising:

a plurality of pulleys for moving the conveyer net, wherein the pulleys are positioned to maintain the conveyer net at a substantial elevation above the horizontal.

3. The machine of claim 1, further comprising:

a plurality of pulleys for moving the conveyer net, wherein the pulleys are positioned to maintain the conveyer net at an angle between the horizontal and the vertical.

4. The machine of claim 1, wherein an angle between the slit passage of the spunbonding apparatus and the conveyer net is from about 0° to about 60°.

5. The machine of claim 1, further comprising:

a suction device for sucking the fiber onto the conveyer net.

6. The machine of claim 5, wherein the suction device is located under the conveyer net.

7. The machine of claim 6, wherein a location on the conveyer net at which the suction device sucks is higher than the projection of the slit passage of the spunbonding apparatus on the conveyer net.

8. The machine of claim 6, wherein a height between a location on the conveyer net at which the suction device sucks and the projection of the slit passage of the spunbonding apparatus on the conveyer net is from about 0 cm to about 10 cm.

9. A machine for manufacturing a nonwoven fabric, the machine comprising:

a conveyer net;

a spunbonding apparatus for projecting at least one fiber onto the conveyer net, wherein the spunbonding apparatus comprises:

at least one nozzle;

a coagulating tank located apart from the nozzle, the coagulating tank comprising:

an inlet facing the nozzle;

an outlet; and a tank wall connecting the inlet to the outlet, the tank wall being liquid-holding such that the coagulating liquid is directly held by the tank wall;

an outer wall covering the tank wall of the coagulating tank, wherein the outer wall and the tank wall of the coagulating tank define a drawing flow passage therebetween;

a slit passage connected to the outlet of the coagulating tank; and a drawing flow pump connecting a drawing flow source to the slit passage for providing a drawing flow to the slit passage through the drawing flow passage to project the fiber onto the conveyer net; and a container for liquid, wherein the liquid level of the container is higher than at least a part of the conveyer net which the fiber is projected onto.

10. The machine of claim 9, further comprising:

a plurality of pulleys for moving the conveyer net, wherein the pulleys are positioned to maintain the conveyer net at a substantial elevation above the horizontal.

11. The machine of claim 9, further comprising:

a plurality of pulleys for moving the conveyer net, wherein the pulleys are positioned to maintain the conveyer net at an angle between the horizontal and the vertical.

12. The machine of claim 9, wherein an angle between the slit passage of the spunbonding apparatus and the conveyer net is from about 0° to about 60°.

13. The machine of claim 9, wherein the liquid level of the container is further higher than the outlet of the slit passage of the spunbonding apparatus.

14. The machine of claim 9, further comprising:

a suction device for sucking the fiber onto the conveyer net.

15. The machine of claim 14, wherein the suction device is located under the conveyer net.

16. The machine of claim 15, wherein a location on the conveyer net at which the suction device sucks is higher than the projection of the slit passage of the spunbonding apparatus on the conveyer net.

17. The machine of claim 15, wherein a height between a location on the conveyer net at which the suction device sucks and the projection of the slit passage of the spunbonding apparatus on the conveyer net is from about 0 cm to about 10 cm.

* * * * *